US005131494A

United States Patent [19]

Heifetz

[11] Patent Number: 5,131,494

[45] Date of Patent: Jul. 21, 1992

[54] EFFECTIVE RISER REDUCER STEP DEVICE

[76] Inventor: Milton M. Heifetz, 580 E. Hudson St., Long Beach, N.Y. 11561

[21] Appl. No.: 749,682

[22] Filed: Aug. 26, 1991

[51] Int. Cl.[5] ..... A47C 9/12

[52] U.S. Cl. ..... 182/106; 182/46; 182/113

[58] Field of Search ..... 182/106, 46, 113

[56] References Cited

U.S. PATENT DOCUMENTS 3,743,051 7/1973 Cramer ..... 182/106
3,841,437 10/1974 Caughey ..... 182/106
3,884,327 5/1975 Zigman ..... 182/106
4,113,161 9/1978 Manuszak ..... 182/106
4,601,364 7/1986 York ..... 182/187
4,844,199 7/1989 Nimz ..... 182/106

*Primary Examiner*—Reinaldo P. Machado
*Attorney, Agent, or Firm*—Michael I. Kroll

[57] ABSTRACT

An effective riser reducer step device is provided, which consists of a mechanism placed upon a tread of a step of a staircase for reducing the height of a riser of the step. Another mechanism is for moving the riser height reducing mechanism to the tread of each successive step of the staircase, so that a physically impaired person suffering from atrophy, back and leg problems can ascend and descend the steps of the staircase.

15 Claims, 2 Drawing Sheets

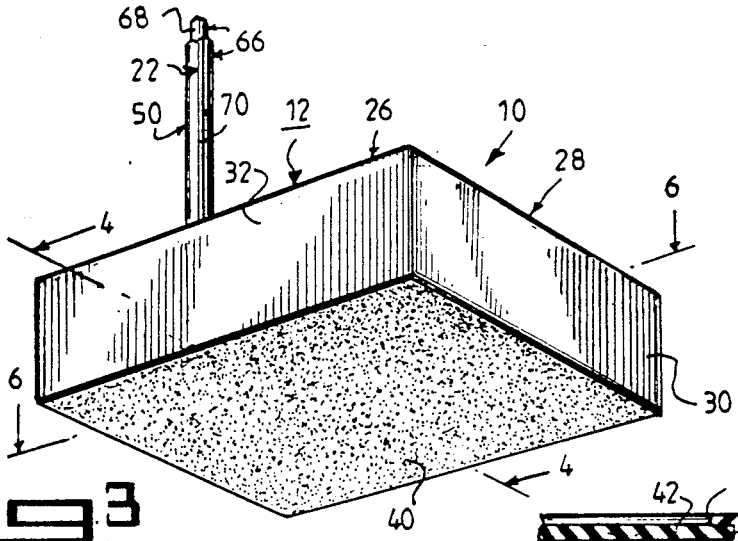
Fig. 3
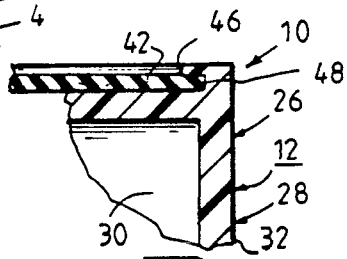
Fig. 5
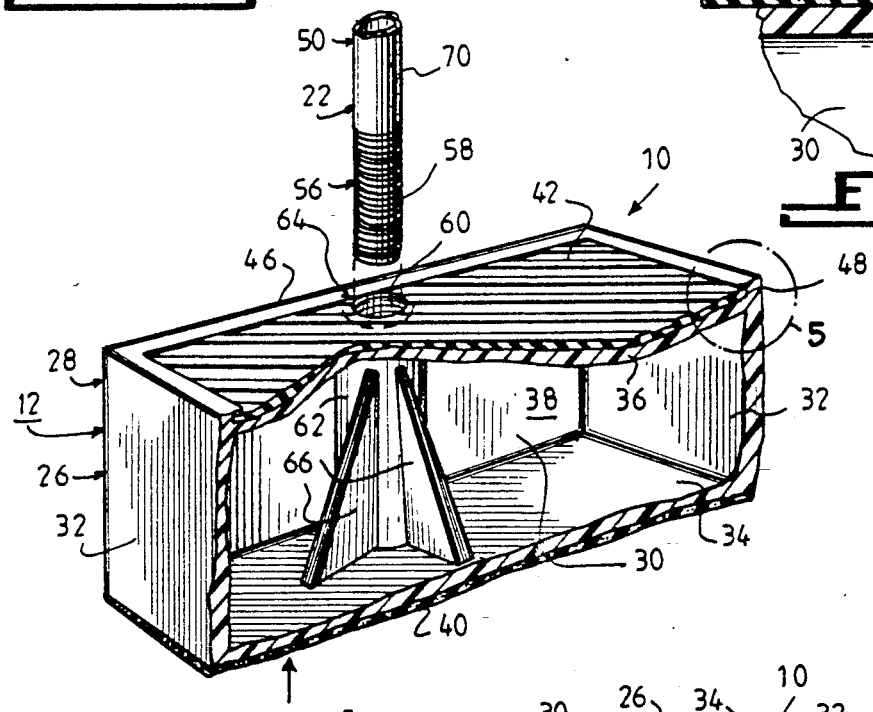
Fig. 4
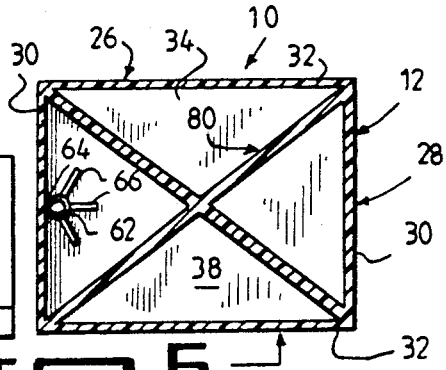
Fig. 6
(OPTIONAL BRACEING STRUCTURE)
| "A" HEIGHT OF RISER IN INCHES | "B" HEIGHT OF PLATFORM IN INCHES | "C" REDUCED HEIGHT OF RISER IN INCHES |
|---|---|---|
| 8 | 4 | 4 |
Fig. 7

EFFECTIVE RISER REDUCER STEP DEVICE

BACKGROUND OF THE INVENTION

1. Field of the Invention

The instant invention relates generally to walking supportive apparatuses and more specifically it relates to an effective riser reducer step device.

2. Description of the Prior Art

Numerous walking supportive apparatuses have been provided in prior art that are adapted to assist people that have minor leg and foot injuries. It can also apply to elderly people who have difficulty in walking due to atrophy, to move along flat surfaces. Canes, walking sticks and crutches can be used, but they can become cumbersome when people are traveling up and down staircases. While these units may be suitable for the particular purpose to which they address, they would not be as suitable for the purposes of the present invention as heretofore described.

SUMMARY OF THE INVENTION

A primary object of the present invention is to provide an effective riser reducer step device that will overcome the shortcomings of the prior art devices.

Another object is to provide an effective riser reducer step device that will aid a physically impaired person suffering from atrophy, back and leg problems who cannot ascend and descend a normal eight inch riser in a staircase, by reducing the riser height in half.

An additional object is to provide an effective riser reducer step device that includes a portable platform having an upright handle at one side thereof, so that the physically impaired person can place the portable platform upon each tread of the staircase and step upon the portable platform to maneuver up and down the staircase.

A further object is to provide an effective riser reducer step device that is simple and easy to use.

A still further object is to provide an effective riser reducer step device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 a top perspective view of the instant part of the handle broken away placed upon a tread of a step in a staircase.

FIGURE 3 is a bottom perspective view of the portable platform with the upright handle broken away.

FIG. 4 is a cross sectional perspective view taken along line 4—4 in FIG. 3.

FIG. 5 is an enlarged detail view as indicated by arrow 5 in FIG. 4.

FIG. 6 is a cross sectional view taken along line 6—6 3, showing an optional bracing structure within the portable platform.

FIG. 7 is a chart showing the function of the instant invent upon the riser of each step of the staircase.

DETAILED DESCRIPTION OF THE PREFERRED EMBODIMENTS

Figure 1:
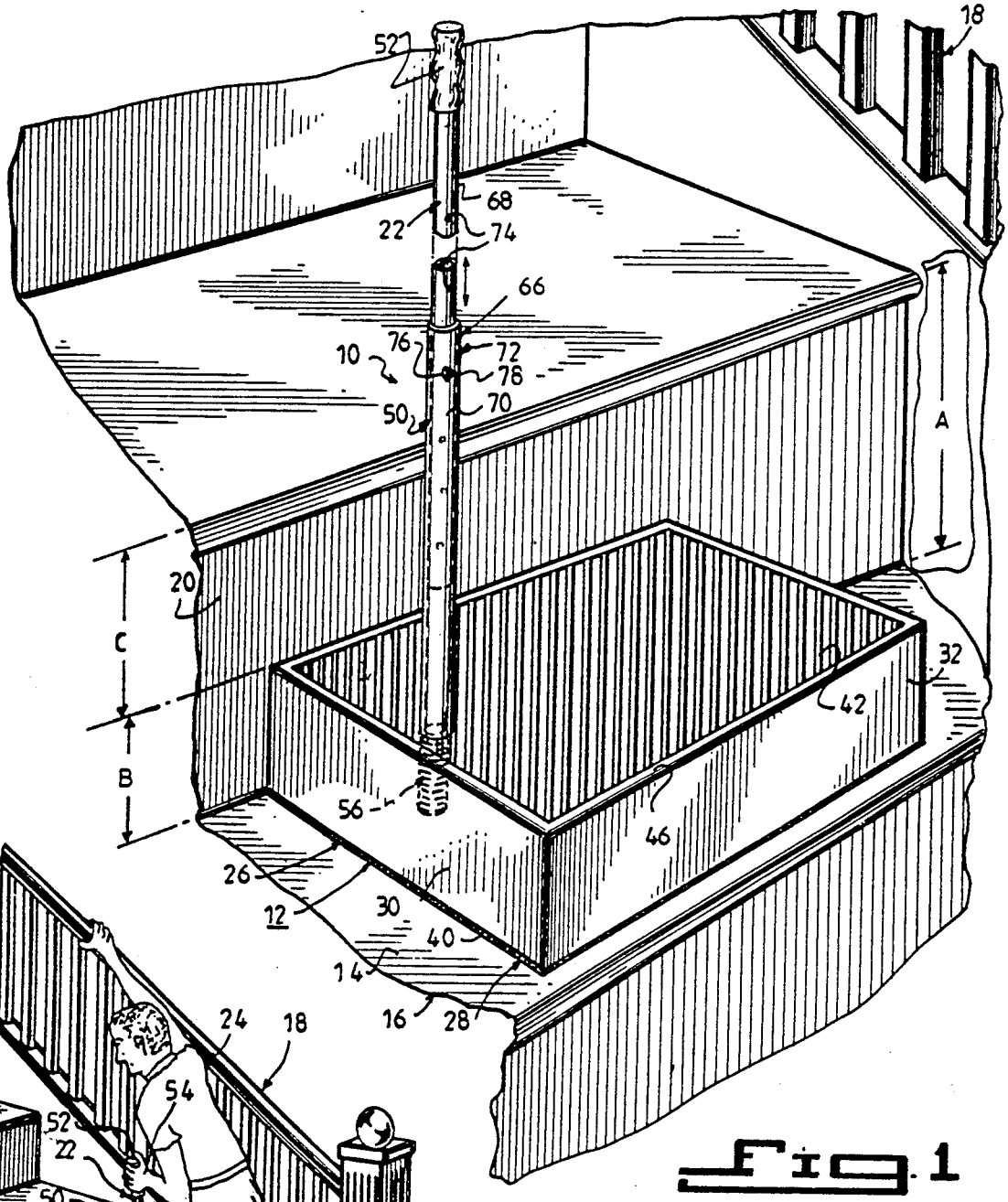
Figure 2:
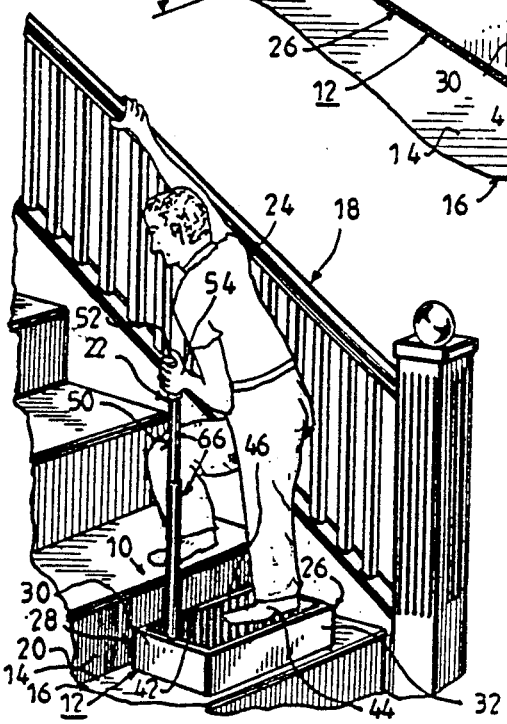
FIG. 2 is a top perspective view of the instant invention being used by a physically impaired person going up the steps of the staircase.

Turning now descriptively to the drawings, in which similar reference characters denote similar elements throughout the several views, the Figures illustrate an effective riser reducer step device 10, which consists of a mechanism 12 placed upon a tread 14 of a step 16, of a staircase 18 for reducing the height of a riser 20 of the step 16. Another mechanism 22 is for moving the riser height reducing mechanism 12 to the tread 14 of each successive step 16 of the staircase 18, so that a physically impaired person 24 suffering from atrophy, back and leg problems can ascend and descend the steps 16 of the staircase 18.

The riser height reducing mechanism 12 is a portable platform 26 having a height of approximately half the height of the riser 20 of each step 16 of the staircase 18. The portable platform 26 is a box-shaped member 28.

The box-shaped member 28 includes a pair of spaced apart short end walls 30, a pair of spaced apart long side wall 32 affixed to the end walls 30, a bottom wall 34 and a top wall 36, thereby forming a hollow chamber 38 within the box-shaped member 28. This makes the box-shaped member 28 light in weight, so that it can be easily moved from place to place.

The box shaped member 28 further includes a first non-skid pad 40 affixed to the underside of the bottom wall 34, so as to prevent the box-shaped member 28 from sliding off the tread 14 of each of the steps 16 of the staircase 18, while at the same time it will not mar carpeting and delicate surfaces. A second non-skid pad 42 is affixed to the upper side of the top wall 36, so as to prevent a foot 44 of the physically impaired person 24 from slipping off of the top wall 36 of the box-shaped member 28.

The top wall 36 of the box-shaped member 28 includes an inwardly facing overhang edge 46 about the perimeter thereof, with the inwardly facing overhang edge 46 having an undercut slot 48. The edges of the second non-skid pad 42 can be inserted into the undercut slot 48 to be better retained to the upper side of the top wall 36.

The box-shaped member 28 is fabricated out of a strong durable and stable plastic material, so that it can properly support the weight of the physically impaired person 24. The first non-skid pad 40 and the second non-skid pad 42 are fabricated out of a rubber material to reduce sliding and slipping.

The moving mechanism 22 is an elongated handle 50 extending upwardly from the top wall 36 of the box-shaped member 28 adjacent one end wall 30 thereof. The physically impaired person 24 can grip the handle 50 and place the box-shaped member 28 upon each tread 14 of each successive step 16 of the staircase 18 to step upon the box-shaped member 28 when ascending and descending the staircase 18. The elongated handle 50 further includes a hand grip 52 affixed to an upper end so that a hand 54 of the physically impaired person 24 can better hold the elongated handle 50.

The elongated handle 50 further includes a mechanism 56 for attaching the elongated handle 50 to and detaching the elongated handle 50 from the top wall 36 of the box-shaped member 28, so that the device 10 can be set up for use and broken down for storage and traveling. The attaching and detaching mechanism 56 includes the elongated handle 50 having an externally threaded lower end 58. The top wall 36 of the box-shaped member 28 has an internally threaded aperture 60, so that the externally threaded lower end 58 of the elongated handle 50 can be threaded into the internally threaded aperture 60.

The attaching and detaching mechanism 56 further includes a boss member 62 having an internally threaded bore 64, adjacent to the end wall 30, with the internally threaded bore 64 in alignment with the internally threaded aperture 60 in the top wall 36. When the externally threaded lower end 58 of the elongated handle 50 is threaded into the internally threaded aperture 60 in the top wall 36, the externally threaded lower end 58 of the elongated handle 50 will also thread into the internally threaded bore 64 in the boss member 62 to be better retained. A plurality of brace members 66 are radially affixed t the side of the boss member 62 and the bottom wall 34 for added strength thereto.

A mechanism 66 is provided for adjusting the height of the elongated handle 50 for different sized physically impaired people 24 Mechanism 66 includes a pair of telescopic members 68 and 70 that fit into each other and a mechanism 72 for locking the telescopic members 68 and 70 together in an adjusted height position.

The locking mechanism 72 includes the first telescopic member 68 having a plurality of spaced apart small threaded transverse holes 74 along its side. The second telescopic member 70 has one small threaded transverse hole 76 in its side. A set screw 78 threads into the one small threaded transverse hole 76 in the second telescopic member 70 and into any one threaded transverse hole 74 in the first telescopic member 68. The set screw 78 will lock the first telescopic member 68 within the second telescopic member 70 at any adjusted height position.

The box-shaped member 28, as shown in FIG. 6, can further include an x-shaped bracing structure 80 therein to add strength and support to the interior of the box-shaped member 28.

LIST OF REFERENCE NUMBERS

10 effective riser reducer step device
12 riser height reducing mechanism
14 tread
16 step
18 staircase
20 riser
22 moving mechanism
24 physically impaired person
26 portable platform for 12
28 box-shaped member for 26
30 short end wall
32 long side wall
34 bottom wall
36 top wall
38 hollow chamber in 28
40 first non-skid pad
42 second non-skid pad
44 foot of 24
inwardly facing overhang edge
undercut slot in 46
50 elongated handle for 22
52 hand grip on 50
54 hand of 24
56 attaching and detaching mechanism
58 externally threaded lower end on 50
60 internally threaded aperture in 36
62 boss member
64 internally threaded bore in 62
66 height adjusting mechanism
68 first telescopic member for 66
70 second telescopic member for 66
72 locking mechanism
74 small threaded transverse hole in 68
76 small threaded transverse hole in 70
78 set screw
80 x-shaped bracing structure It will be understood that each of the elements described above, or two or more together may also find useful application in other types of a methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An effective riser reducer step device which comprises:

a) means placed upon a tread of a step of a staircase for reducing the height of a riser of the step, said means is a portable platform having uninterrupted upper surface and a height of approximately half the height of the riser of each step of the staircase, said portable platform is a unitary box-shaped member; and b) means for moving said riser height reducing means to the tread of each successive step of the staircase so that a physically impaired person suffering from atrophy back and leg problems can ascend and descend the steps of the staircase, said moving means is a rigid elongated handle extending upwardly from said uninterrupted upper surface.

2. An effective riser reducer step device as recited in claim 1, wherein said box-shaped member includes:

a) a pair of spaced apart short end walls;

b) a pair of spaced apart long side walls affixed to said end walls;

c) a bottom wall; and d) a top wall, thereby forming a hollow chamber within said box-shaped member, to make said box-shaped member light in weight, so that it can be easily moved from place to place.

3. An effective riser reducer step device as recited in claim 2, wherein said box-shaped member further includes:

a first non-skid pad affixed to the underside of said bottom wall, so as to prevent said box shaped member from sliding off the tread of each of the steps of the staircase, while at the same time it will not mar carpeting and delicate surfaces; and b) a second non-skid pad affixed to the upper side of said top wall, so as to prevent a foot of the physically impaired person from slipping off of the top wall of said box-shaped member.

4. An effective riser reducer step device as recited in claim 3, wherein said top wall of said box-shaped member includes an inwardly facing overhang edge about the perimeter thereof, with said inwardly facing overhang edge having an undercut slot, so that the edges of said second non-skid pad can be inserted into said undercut slot to be better retained to the upper side of said top wall.

5. An effective riser reducer step device as recited in claim 4, wherein said box-shaped member is fabricated out of a strong durable and stable plastic material, so that it can properly support the weight of the physically impaired person.

6. An effective riser reducer step device as recited in claim 5, wherein said first non-skid pad and said second non-skid pad are fabricated out of a rubber material to reduce sliding and slipping.

7. An effective riser reducer step device as recited in claim 6, wherein said moving means is an elongated handle extending upwardly form said top wall of said box-shaped member adjacent one said end wall thereof, so that the physically impaired person can grip the handle and place said box-shaped member upon each tread of each successive step of the staircase to step upon said box-shaped member when ascending and descending the staircase.

8. An effective riser reducer step device as recited in claim 7, wherein said elongated handle further includes a hand grip affixed to an upper end so that a hand of the physically impaired person can better hold said elongated handle.

9. An effective riser reducer step device as recited in claim 8, wherein said elongated handle further includes means for attaching said elongated handle to and detaching said elongated handle from said top wall of said box-shaped member, so that said device can be set up for use and broken down for storage and traveling.

10. An effective riser reducer step device as recited in claim 9, wherein said attaching and detaching means includes:

a) said elongated handle having an externally threaded lower end; and b) said top wall of said box-shaped member having an internally threaded aperture, so that said externally threaded lower end of said elongated handle can be threaded into said internally threaded aperture.

11. An effective riser reducer step device as recited in claim 10, wherein said attaching and detaching means includes:

a) a boss member having an internally threaded bore, being adjacent to said end wall, with said internally threaded bore in alignment with said internally threaded aperture in said top wall, so that when said externally threaded lower end of said elongated handle is threaded into said internally threaded aperture in said top wall, said externally threaded lower end of said elongated handle will also thread into said internally threaded bore in said boss member to be better retained; and b) a plurality of brace members radially affixed to the side of said boss member and said bottom wall for added strength thereto.

12. An effective riser reducer step device as recited in claim 11, further including means for adjusting the height of said elongated handle for different sized physically impaired people.

13. An effective riser reducer step device as recited in claim 12, wherein said height adjusting means includes:

a) a pair of telescopic members that fit into each other; and b) means for locking said telescopic members together in an adjusted height position.

14. An effective riser r step device as recited in claim 13, wherein said locking means includes:

a) said first telescopic member having a plurality of spaced apart small threaded transverse holes along its side;

b) said second telescopic member having one small threaded transverse hole in its side; and c) a set screw to thread into said one small threaded transverse hole in said second telescopic member and into any one threaded transverse hole in said first telescopic member, so that said set screw will lock said first telescopic member within said second telescopic member at any adjusted height position.

15. An effective riser reducer step device as recited in claim 14, wherein said box-shaped member further includes an x-shaped bracing structure therein to add strength and support to the interior of said box-shaped member.

* * * * *